United States Patent [19]

Chandross et al.

[11] 3,964,939

[45] June 22, 1976

[54] BODIES INCLUDING PASSIVATED METAL PARTICLES

[75] Inventors: Edwin Arthur Chandross; Murray Robbins, both of Berkeley Heights; Harold Schonhorn, New Providence, all of N.J.

[73] Assignee: Bell Telephone Laboratories, Incorporated, Murray Hill, N.J.

[22] Filed: Dec. 26, 1974

[21] Appl. No.: 536,377

[52] U.S. Cl. ..... 148/105; 148/103; 148/104; 75/.5 AA

[51] Int. Cl.[2] ..... H01F 1/02

[58] Field of Search ..... 148/105, 104, 103, 31.55; 75/.5 A, .5 AA; 427/127, 128, 132; 252/62.5; 261/DIG. 58

[56] References Cited

UNITED STATES PATENTS

| | | | |
|---|---|---|---|
| 1,982,689 | 12/1934 | Polydoroff | 264/DIG. 58 |
| 2,158,132 | 5/1939 | Legg | 148/104 |
| 3,120,698 | 2/1964 | Elliott | 148/105 |
| 3,206,338 | 9/1965 | Miller et al. | 148/105 |
| 3,228,881 | 1/1966 | Thomas | 427/127 |
| 3,228,882 | 1/1966 | Harle et al. | 252/62.5 |
| 3,290,252 | 12/1966 | Larsen et al. | 252/62.5 |
| 3,300,329 | 1/1967 | Orsino et al. | 427/128 |
| 3,556,838 | 1/1971 | Segura | 427/127 |
| 3,661,556 | 5/1972 | Jolley et al. | 75/.5 AA |
| 3,785,881 | 1/1974 | Naastepad et al. | 148/103 |

OTHER PUBLICATIONS

Robbins, M; Stabilization of ... Iron Particles by ... Polymerization, J. Electrochem. Soc., Jan. 1970, pp. 137–139.

Hoar, T; Inhibition by ... Thioureas ... Dissolution of Mild Steel, J. Appl. Chem., Nov. 1953, pp. 502–513.

*Primary Examiner*—Walter R. Satterfield
*Attorney, Agent, or Firm*—A.N. Friedman

[57] ABSTRACT

Long term protection against oxidation is provided to fine particles of oxidizable metals and metallic alloys by treating the essentially oxide-free particles with a solution of certain organic materials in a nonreactive organic solvent. These organic materials are ureas, thioureas, isocyanates or isothiocyanates with at least one organic substituent each containing at least two carbons. Particles of both hard and soft magnetic metals and alloys have been protected by this treatment.

4 Claims, 3 Drawing Figures

BODIES INCLUDING PASSIVATED METAL PARTICLES

BACKGROUND OF THE INVENTION

1. Field of the Invention

The invention lies in the field of the production of metallic powders and metallic powder-containing devices which are protected against corrosion.

2. Brief Description of the Prior Art

The extensive literature in the general field of the protection of metals against the degrading influence of the ambient atmosphere, includes many references describing the protection of fine metallic particles against oxidation by encapsulating them in polymers (e.g., U.S. Pat. Nos. 3,556,838; 3,228,881; 3,228,882; 3,526,533 and 3,300,329). Such protection is necessary because many metals in finely divided form are so reactive as to burst into flame spontaneously upon exposure to air. Many others, which are not so pyrophoric, nevertheless, degrade too rapidly for device use in the absence of some protective treatment. In protective methods heretofore used, long chain polymers are employed to form a physically thick barrier against the interaction of oxygen with the surface of the metallic particle. In such methods it has been shown (*Journal of the Electrochemical Society*, 117 (1970) p. 137) that the reduction of the amount of protective material surrounding each particle tends to reduce the effectiveness of this corrosion protection treatment. The necessity to use a relatively large polymer volume, relative to the volume of metal is disadvantageous in many device uses.

SUMMARY OF THE INVENTION

A class of compounds has been found, which, without polymerization, passivate fine particles of oxidizable metals. These compounds are ureas, thioureas, isocyanates and isothiocyanates containing at least one organic substituent with at least two carbons. For passivation these compounds are applied to the essentially oxide-free metal powders by immersing the powders in a solution of the protective species in a nonreactive organic solvent. It is considered that corrosion protection is achieved in this method by some modification of the surface properties of the particle. Evidence for this lies in the fact that it has been found that the degree of protection is insensitive to the molecular weight of the substituents. Indeed, the amount of organic material incorporated in the final device can be minimized by washing the powders in pure solvent after treatment in the protective solution with little or no effect on the degree of protection. Iron powders, suitable for such uses as transformer cores and magnetic recording tape, and $Co_5Sm$ powders, suitable for the production of permanent magnets, have been protected by this method and have shown little degradation after long term aging at room temperature and accelerated aging at high temperatures in air or moist oxygen.

DETAILED DESCRIPTION OF THE INVENTION

Protective Materials

Figure 1:
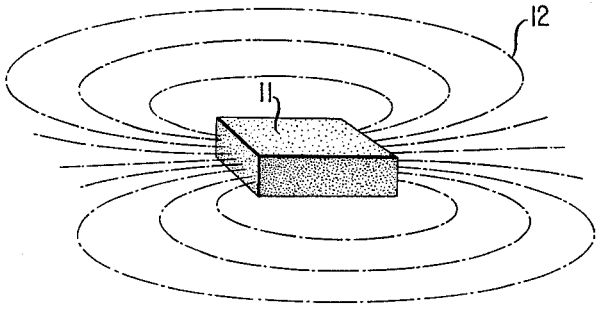
FIG. 1 is a perspective view of a permanent magnet incorporating powders protected by the inventive method.

Passivation of fine powders has been accomplished by surface treatment of these powders with certain nonpolymeric organic materials. These materials are ureas, thioureas, isocyanates and isothiocyanates, containing at least one organic substituent. The ureas are of the general structure:

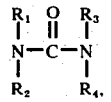

in which $R_1$, $R_2$, $R_3$ and $R_4$ can be hydrogen or an organic substituent. The thioureas are of the general structure:

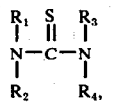

in which $R_1$, $R_2$, $R_3$ and $R_4$ can be hydrogen or an organic substituent. The isocyanates are of the general structure:

$$R - N = C = O,$$

where R is an organic substituent. The isothiocyanates are of the general structure:

$$R - N = C = S,$$

where R is an organic substituent. The substituents can be alkyl, aryl, branched alkyl or some combination of these. Some examples of effective protective compounds are N,N'diheptylthiourea, octadecylthiourea, octadecylisothiocyanate, octadecylurea, N,N'diphenylthiourea, phenylisothiocyanate and N,N'diisopropylthiourea. The substituent should have at least two carbons in order to promote solution of these compounds in the nonreactive organic solvents used to treat the metallic particles. In order to provide rapid protection, the compound used should be soluble to an extent of at least 0.05 moles per liter in the organic solvent used. Somewhat lower solubility is still operative but requires longer processing time in order to provide equivalent protection. Solubility is influenced, in a well recognized way by the weight, number and position of the substituents. In general, compounds with heavier substituents tend to be more soluble than lighter compounds and compounds with symmetric substitution of substituents tend to be more soluble than asymmetric compounds.

Beyond the solubility requirement it has been found that the degree of corrosion protection is insensitive to the molecular weight and number of the substituent. For example, N,N'diethylthiourea was found to be at least as effective as N,N'diheptylthiourea and octadecylurea. It is postulated that there is a surface chemical reaction between the particle and the oxygen or sulphur portion of the urea, etc., moiety of the protective compound. Such a reaction seems to modify the surface activity so as to inhibit reaction of the surface with ambient oxygen. As nearly as can be determined this reaction results in the formation of a monolayer of the protective compound over the surface of the particle. The use of compounds with substituents containing more than 20 carbons is not recommended in that such compounds are more expensive while offering little or no additional protection. They merely serve to reduce the concentration of metal in the product body.

Process

To achieve optimum protection by the method described below the material particles should be essentially oxide free. It is considered that this results in a maximum surface reaction with the protecting compound. The presence of some oxide results in some diminution of the degree of protection. However, this dos not completely destroy the protection afforded by this process. Essentially oxide-free particles can be produced by such methods as the hydrogen reduction of the metallic oxide or the crushing or grinding of larger metallic bodies in an inert or reducing atmosphere or directly in a solution of the protective compound. In addition many organometallic compounds decompose upon heating to leave metal particles. After being produced the particles are maintained in an essentially oxide-free state until treated with the protective compound.

The advantage of the described protective treatment varies somewhat with the size and chemical nature of the particles being protected. The treatment will be most advantageous where oxidation of the particle surface would produce deleterious effects on device performance or changes in device performance with time. In most cases such effects will be significant only when oxidation consumes more than approximately 1 percent of the volume of each particle. For materials, such as Ti and A1 which gain a protective oxide coating upon oxidation, the oxidation process consumes up to approximately 10 atomic layers of material. For materials, such as Fe, Co, Ni and similar transition and rare earth metals and their alloys (e.g. $Co_5Sm$) which gain a nonprotective oxide coating the oxidation process penetrates much deeper into the particle so that the protective process is advantageous for particles as large as 100 micrometers.

In order to protect the essentially oxide-free particles they are immersed in a solution of the protective compound or compounds in a solvent which does not, itself, produce chemical change in the particles. For example, nonreactive organic solvents, such as benzene or cyclohexane are useful. After as much stirring or agitation as is necessary to assure that all particles have been contacted by the solution of protective compound, the solution is drained from the particles. The particles may then be rinsed with solvent if it is wished to minimize the amount of organic material remaining. The organic content of the powder can easily be kept to less than 5 weight percent. By careful rinsing, the organic content can be kept to less than 1 weight percent.

The particles, protected by this method are then fabricated into a solid body suitable for the intended use. Such fabrication steps may first entail drying of the protected powders. Fabrication into a solid may entail the addition of some binder material, such as might be used in the fabrication of a magnetic recording tape (see FIG. 2) or an inductor (see FIG. 3). Such devices can incorporate iron particles. Other possible fabrication techniques can include pressure and heat, simultaneously or in sequence. Such processes can be used in the fabrication of permanent magnets (see FIG. 1) such as might incorporate $Co_5Sm$ powders.

Figure 2:
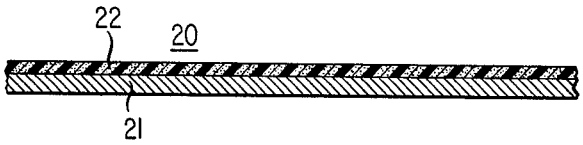
FIG. 2 is an elevational view in section of a magnetic recording tape.
Figure 3:
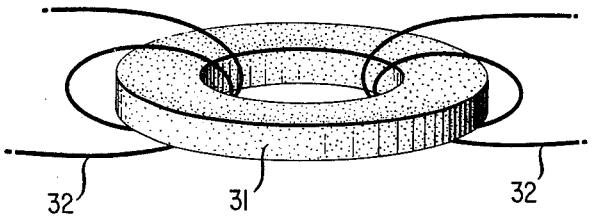
FIG. 3 is a perspective view of a transformer or inductor incorporating a powder core.

FIG. 1 shows a body 11, including a quantity of protected powder, which has been fabricated into a permanent magnet as indicated by the illustration of magnetic lines of force 12. FIG. 2 shows a magnetic recording tape 20. The recording tape includes a polymeric substrate 21 and a magnetic layer 22 which consists of a quantity of protected iron powder in a polymeric binder. FIG. 3 shows a transformer or inductor consisting of a core 31, including a quantity of protected ferromagnetic powder and associated conducting windings 32. Bodies including quantities of protected nonmagnetic metals and alloys can be used in such devices as microwave terminations.

Examples

Iron powders whose average least dimension was 0.3 micrometer were produced by hydrogen reduction of $\gamma$-ferric oxide. The ferric oxide particles were placed in a ceramic crucible and heated to 400°C while maintaining a flow of hydrogen gas through the reaction vessel. The powders were cooled to room temperature and, while still in a hydrogen atmosphere, were immersed in a 5 weight percent solution of the protective compound in benzene. The protected powders were filtered from the solution, rinsed in fresh benzene, and then dried at 60°C at a reduced pressure of approximately 100 Torr. The saturation magnetization of the powders was measured soon after treatment and again after aging. The results of these measurements and the aging method used are indicated in Table I for several exemplary protective materials. For comparison the saturation magnetization of pure iron is indicated. While the saturation magnetization of the protected powders is less than that of pure iron it is significantly greater than the saturation magnetization reported for powders protected by encapsulation in polymers (*Journal of the Electrochemical Society*, 117 (1970)138).

$Co_5Sm$ powders were prepared in an essentially oxide-free state by grinding of arc melted pieces while immersed in a 5 percent solution of N,N'diheptylthiourea in benzene, rinsed and dried. No significant weight increase was observed after accelerated aging by flowing water saturated oxygen gas over the powders at 60°C for moe than 100 hours.

A magnetic recording band was made by mixing together 145 grams of iron particles, protectively treated with N,N'diheptylthiourea together with 131 grams of commercial, polymer based binder mixture. The mixture was cast in a recording band mold and cured at 150°C for 15 minutes. The recording response of the band was satisfactory.

TABLE I

| PROTECTIVE MATERIAL | AGING HISTORY | SATURATION MAGNETIZATION (Og in emu/gm) |
|---|---|---|
| N,N'diheptylthiourea | as prepared | 151 |
| | one day in air at 100°C | 139 |
| | 10 days in air at 100°C | 136 |
| N,N'diethylthiourea | as prepared | 169 |

TABLE I-continued

| PROTECTIVE MATERIAL | AGING HISTORY | SATURATION MAGNETIZATION (Og in emu/gm) |
|---|---|---|
| | 10 days in air at 100°C | 142 |
| | >1 year in air at 35°C | 150 |
| Octadecylthiourea | as prepared | 176 |
| Octadecylisothiocyanate | as prepared | 159 |
| | 10 days in air at 100°C | 139 |
| N,N'diheptylurea | as prepared | 173 |
| | >1 year in air at 25°C | 165 |
| Octadecylurea | as prepared | 177 |
| | >1 year in air at 25°C | 152 |
| Pure bulk iron | | 218 |

What is claimed is:

1. A body including particulate matter, which particulate matter consists essentially of essentially oxide free particles of an oxidizable metal, whose average least dimension is less than 100 micrometers, in intimate contact with an organic substance wherein the organic substance is at least one molecular species present on the surface of the particles in sufficient quantity to provide a surface layer at least one monolayer thick on each particle but constitutes less than five percent of the weight of the matter, wherein the at least one molecular species is selected from the group consisting of a urea, a thiourea, an isocyanate and an isothiocyanate which molecular species contains at least one organic substituent, which substituent contains at least two carbons.

2. A body of claim 1 in which the oxidizable metal is ferromagnetic.

3. A body of claim 1 in which the organic substance constitutes less than one percent of the weight of the matter.

4. A body of claim 1 in which the at least one molecular species is N,N'diheptylthiourea, N,N'diethylthiourea, octadecylthiourea, N,N'diheptylurea or octadecylurea.

* * * * *